US011191141B1

(12) United States Patent
Lopez et al.

(10) Patent No.: US 11,191,141 B1
(45) Date of Patent: Nov. 30, 2021

(54) POWERING MICROLEDS CONSIDERING OUTLIER PIXELS

(71) Applicants: Toni Lopez, Aachen (DE); Zhi Hua Song, Palo Alto, CA (US); Ronald Johannes Bonne, Plainfield, IL (US)

(72) Inventors: Toni Lopez, Aachen (DE); Zhi Hua Song, Palo Alto, CA (US); Ronald Johannes Bonne, Plainfield, IL (US)

(73) Assignee: Lumileds LLC, San Jose, CA (US)

( * ) Notice: Subject to any disclaimer, the term of this patent is extended or adjusted under 35 U.S.C. 154(b) by 0 days.

(21) Appl. No.: 17/125,841

(22) Filed: Dec. 17, 2020

(51) Int. Cl.
*H05B 45/30* (2020.01)
*H05B 45/325* (2020.01)
*G09G 3/32* (2016.01)

(52) U.S. Cl.
CPC ..... *H05B 45/325* (2020.01); *G09G 3/32* (2013.01); *G09G 2300/08* (2013.01); *G09G 2320/064* (2013.01); *G09G 2360/18* (2013.01)

(58) Field of Classification Search
CPC ..... H05B 45/10; H05B 45/14; H05B 45/30; H05B 45/31; H05B 45/325; H05B 45/44; H05B 45/46; H05B 45/52; G09G 3/32; G09G 3/3225; G09G 3/3233; G09G 3/34; G09G 3/3406
See application file for complete search history.

(56) References Cited

U.S. PATENT DOCUMENTS

| | | | | |
|---|---|---|---|---|
| 8,120,555 | B2 | 2/2012 | Cok | |
| 9,516,723 | B2 * | 12/2016 | Mao | H05B 45/39 |
| 9,578,702 | B2 | 2/2017 | Siessegger et al. | |
| 2006/0044864 | A1 * | 3/2006 | Lin | H01L 25/0753 365/151 |
| 2016/0218191 | A1 * | 7/2016 | Masuoka | H01L 29/66833 |
| 2017/0330509 | A1 | 11/2017 | Cok et al. | |
| 2018/0070417 | A1 * | 3/2018 | Galvano | H05B 45/56 |
| 2018/0174931 | A1 * | 6/2018 | Henley | G01R 31/2635 |
| 2019/0147793 | A1 | 5/2019 | Valentine | |
| 2020/0084868 | A1 | 3/2020 | Bonne | |

* cited by examiner

*Primary Examiner* — Thai Pham
(74) *Attorney, Agent, or Firm* — Schwegman Lundberg & Woessner, P.A.

(57) ABSTRACT

A light-emitting apparatus can reduce a number of undriven or underdriven uLEDs in a uLED die. A method can include providing, by a power supply and during a first time, electrical power with a first voltage sufficient to operate a majority of micro light emitting diodes (uLEDs) of a uLED die to respective uLED drivers of the uLED die, driving the majority of uLEDs of the uLED die using the uLED drivers during the first time, providing, by the power supply and during a second time after the first time, electrical power with a second voltage, the second voltage higher than the first voltage and sufficient to operate uLEDs of the uLED die that are not operable by the first voltage, and driving the majority of the uLEDs and the uLEDs of the uLED die that are not operable by the first voltage during the second time.

20 Claims, 12 Drawing Sheets

POWERING MICROLEDS CONSIDERING OUTLIER PIXELS

TECHNICAL FIELD

The present disclosure relates to a light-emitting apparatus and a light-emitting apparatus control system configured to reduce or eliminate dark aberrations experienced with an abnormally high forward voltage ($V_f$).

BACKGROUND

In some applications, such as home or commercial lighting, user experience in terms of visible effect of the lighting is very important. Automotive lighting is another application in which user experience is very important. If a forward voltage of a light emitting diode (LED) is above the supply voltage, the LED will likely not operate as expected. Such LEDs can appear as black or darker spots among lit LEDs.

BRIEF DESCRIPTION OF THE DRAWINGS

The figures show various views of an apparatus, system, or method, including a control system that can alter light emerging from one or more light emitting diodes (LEDs), in accordance with some embodiments. The terms "front," "rear," "top," "side," and other directional terms are used merely for convenience in describing the apparatuses and systems and other elements and should not be construed as limiting in any way.

DETAILED DESCRIPTION

Figure 1:
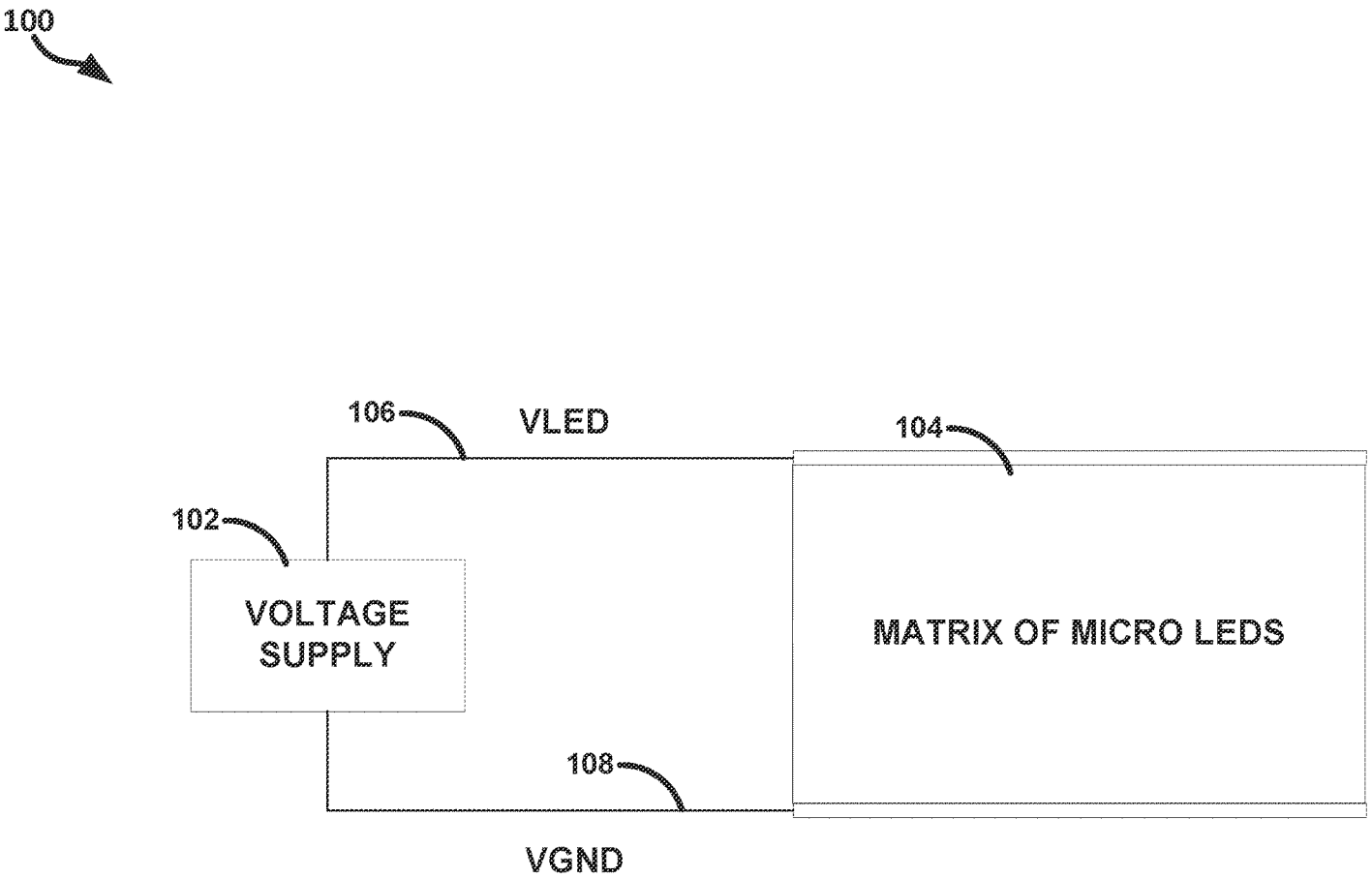
FIG. 1 illustrates, by way of example, a logical block diagram of an embodiment of a system for driving a die including a matrix of micro LEDs (uLEDs).

Compact, pixelated LEDs, such as in an array of micro LEDs (sometimes presented as "uLED") on a uLED die, can include a large monolithic area. The uLED array can be used for automotive lighting, such as headlights, taillights, parking lights, fog lamps, direction lights, or the like. Such applications are merely examples and many other applications of uLED arrays are possible.

The uLED array can include a die of uLEDs hybridized with driver electronics for the control of individual pixel brightness. The driver electronics can be manufactured using, for example, complementary metal oxide semiconductor (CMOS) materials or processes or other semiconductor manufacturing processes.

In some embodiments, the driver electronics can implement a linear driving scheme. The linear driving schemes are one practical solution for such control electronics, particularly for large uLED array configurations. However, special care is demanded in a linear driving scheme to control the voltage supply to the driver electronics, such as to provide both stable uLED current supply and acceptable heat losses. To guarantee that all pixel drivers are operated above their compliance voltage, the voltage supply to the driver electronics is generally set above the highest forward voltage ($V_f$) of the uLEDs in the array.

An advantage of monolithic uLED chips is that they favor a narrow dispersion of forward voltages ($V_f$) among the uLED population (e.g., standard deviations <100 milliVolts). This forward voltage ($V_f$) homogeneity reduces heat loss, such as by reducing a voltage difference between a voltage supplied and the forward voltage ($V_f$) of the uLEDs. Unfortunately, there still exists a small but relevant group of outlier uLEDs whose forward voltage ($V_f$) is excessively high (e.g., greater than 20%, 25%, a greater or lesser percentage, or a percentage therebetween higher than the average forward voltage ($V_f$) of the uLEDs).

One solution to providing sufficient supply voltage includes providing a supply voltage that is greater than (or equal to) a highest $V_f$ for all of the uLEDs on the die, including the outliers. Using this solution, all uLEDs, including the outliers, will be properly driven. However, heat losses will increase (in some practical cases, to prohibitive levels) as the voltage drop across the driver electronics will, on average, increase.

Another solution includes no consideration for outlier uLEDs. Such skipping of outliers allows the supply voltage to remain low, thereby benefiting from the narrow forward voltage ($V_f$) dispersion among the uLEDs. In this solution, heat losses will be reduced compared to the solution that increases the voltage supply voltage to account for one or more of the $V_f$ of outliers. However, using such a solution, it is likely that some outlier uLEDs will be undriven and/or underdriven. Such undriven or underdriven uLEDs can appear as dark spots on the uLED array. A bigger population of outliers can be prohibitive in some applications, especially if the undriven and/or underdriven uLEDs remain visible.

Embodiments can include a (e.g., simple) driving scheme to provide voltage compliance to outlier uLED drivers so that the corresponding uLEDs can light up with minor impact on heat losses. Advantages provided by embodiments can address one or more of the following challenges of pixelated matrix LEDs driven with linear driver schemes: (1) providing a cost-effective driving scheme of matrix uLEDs; (2) overcoming driver efficiency limitations; (3) overcoming voltage compliance limitations; or (4) addressing forward voltage dispersion across population of pixels where outliers compromise either voltage compliance or driver efficiency.

FIG. 1 illustrates, by way of example, a diagram of an embodiment of a uLED control system 100. The system 100 as illustrated includes a voltage supply 102 that provides power distributed by a plurality of LED drivers to a matrix of uLEDs 104. The voltage supply 102 provides a constant direct current (DC) voltage $V_{LED}$ 106 and a constant reference voltage $V_{GND}$ 108. The voltage supply 102 can fix the voltage supply to the DC level of $V_{LED}$ 106. This voltage does not dynamically change with a load line response (a load of the array of uLEDs 104). Thus, $V_{LED}$ 106 does not change dynamically change during a pulse width modulation (PWM) period of the current driver signals.

As previously discussed, if $V_{LED}$ 106 is set to account for the outlier pixels of the array of uLEDs 104, the heat losses in the drivers of the uLEDs will be high (even prohibitively high). Conversely, if the $V_{LED}$ 106 is set without consideration of the $V_f$ of the outlier uLEDs, the outlier uLEDs can remain undriven or underdriven. Such undriven or underdriven LEDs can appear as dark spots in the matrix of uLEDs 104.

Figure 2:
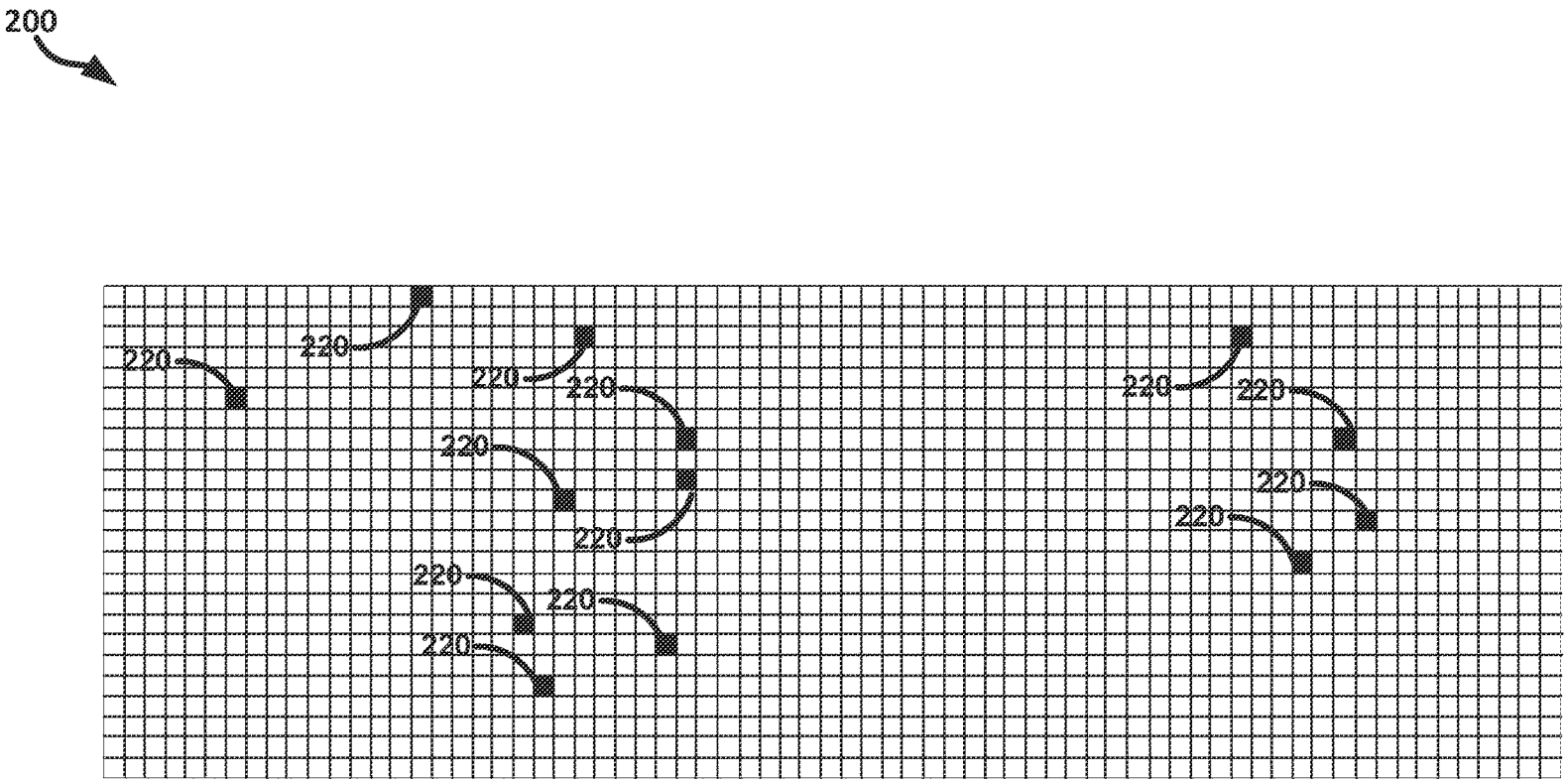
FIG. 2 illustrates, by way of example, a perspective view of an embodiment of a uLED die that includes undriven and/or underdriven uLEDs.

FIG. 2 illustrates, by way of example, a diagram of an embodiment of an array of uLEDs 200 driven without consideration of $V_f$ of the outlier uLEDs. As can be seen, some uLEDs remain undriven or under driven, resulting in black or darker spots 220 in the array of uLEDs 200.

Figure 3:
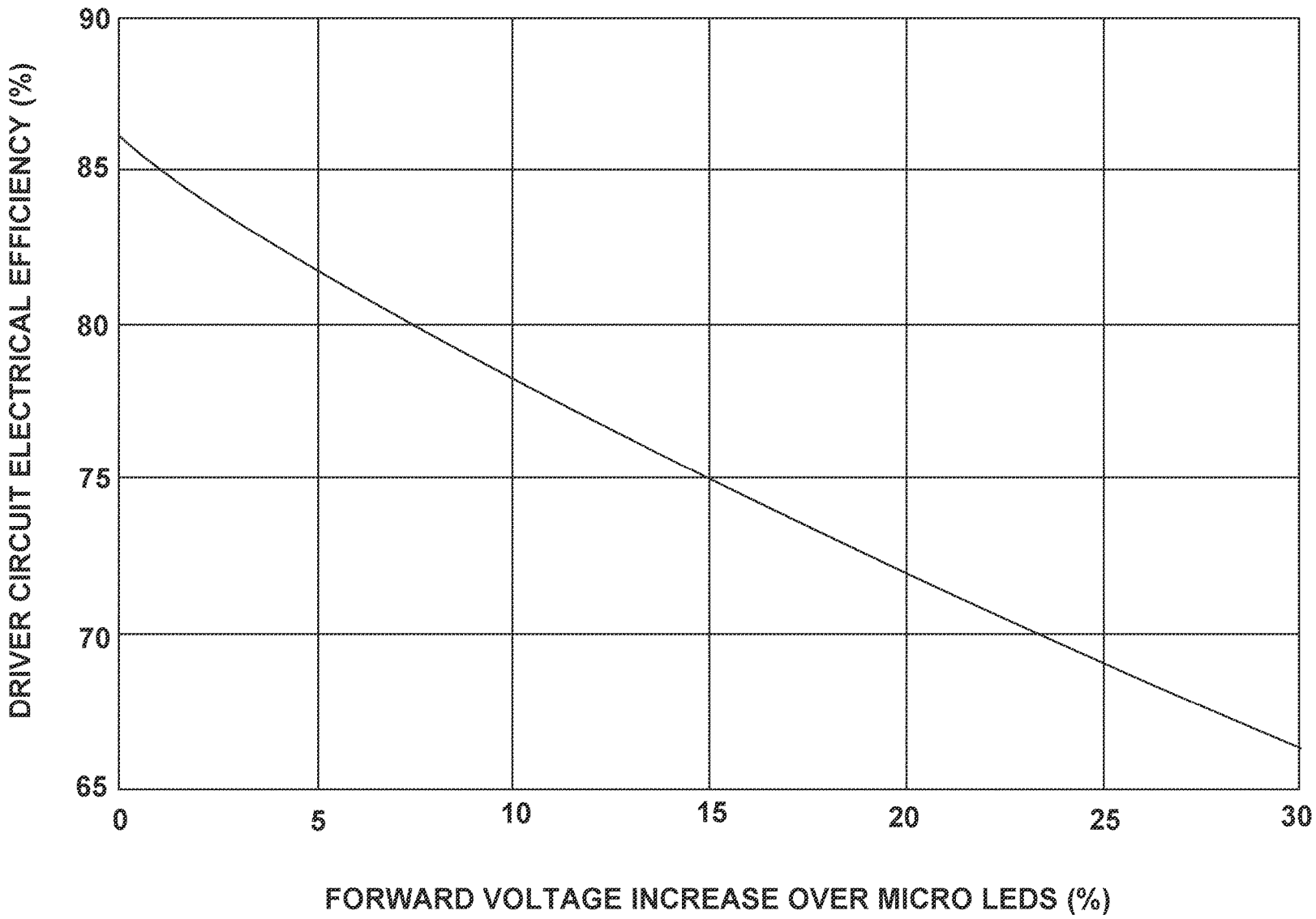
FIG. 3 illustrates, by way of example, a graph of driver circuit electrical efficiency versus uLED forward voltage ($V_f$).

FIG. 3 illustrates, by way of example, a diagram of an embodiment of a graph of efficiency versus number of outlier uLEDs (as a % of all uLEDs in the array of uLEDs 200). As can be seen, as the percentage of pixels that are considered outliers increases, the driver circuit electrical efficiency decreases. A goal can be to keep the electrical efficiency greater than, for example, 85%, 80%, a greater of lesser percentage or some percentage therebetween. Electrical efficiency is defined as power output divided by the power provided. For example, if the outlier $V_f$ increases by 20% over the population of LEDs in the matrix of uLEDs 104, the driver efficiency drops from 86% (reference efficiency considering no outliers) down to 72%.

Figure 4:
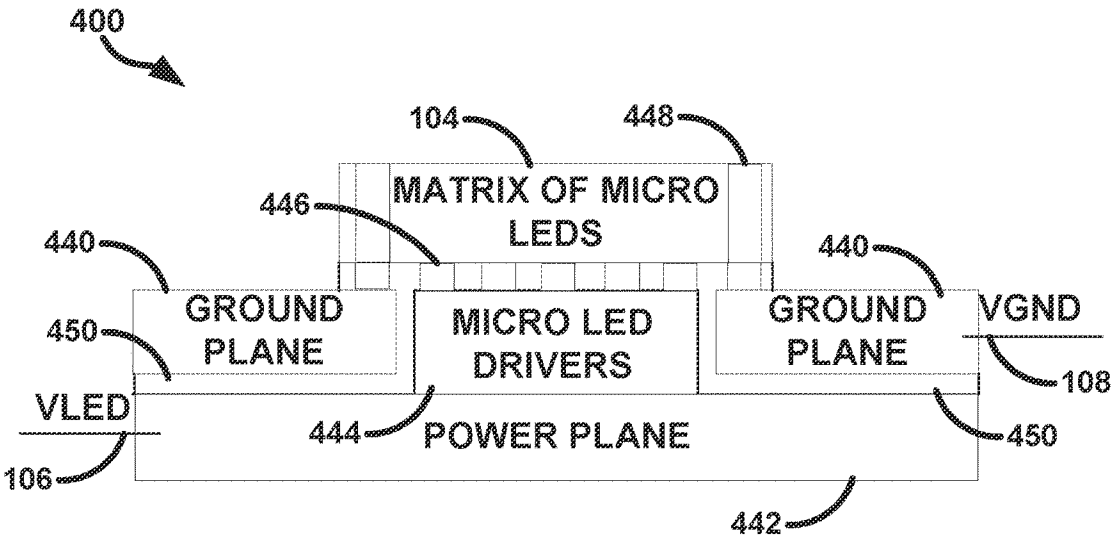
FIG. 4 illustrates, by way of example, a conceptual block diagram of an embodiment of a package including a matrix of uLEDs and corresponding driver circuitry.

FIG. 4 illustrates, by way of example, a logical block diagram of an embodiment of a system 400 including an electrical backplane electrically coupled to the matrix of uLEDs 104. The electrical backplane includes uLED drivers 444 and power provisioning circuitry. Further details of a linear driver version of the uLED drivers 444 are provided regarding FIG. 5. The power provisioning circuitry includes $V_{LED}$ 106 and the reference voltage $V_{GND}$ 108 from the power supply. The $V_{LED}$ 106 is provided to a power plane 442. The $V_{GND}$ 108 is provided to a ground plane 440. The uLED drivers 444 are powered using the $V_{LED}$ 106 from the power plane 442. The uLED drivers 444 control, via an electrical interconnect 446 individual or groups of uLEDs in the matrix of uLEDS 104. The uLED drivers 444 can control whether the uLED is on, off, a duty cycle, or other power control of the uLEDs 104.

The matrix of uLEDs 104 are electrically coupled to the uLED drivers 444 through the electrical interconnects 446. The matrix of uLEDs 104 are electrically coupled to the ground plane 440 through other electrical interconnects 448. A dielectric 450 electrically and physically separates the uLED drivers 444 from the ground plane 440. That is, the dielectric 450 is situated (e.g., directly) between the uLED drivers 444 and the ground plane 440 and (e.g., directly) between the ground plane 440 and the power plane 442.

Figure 5:
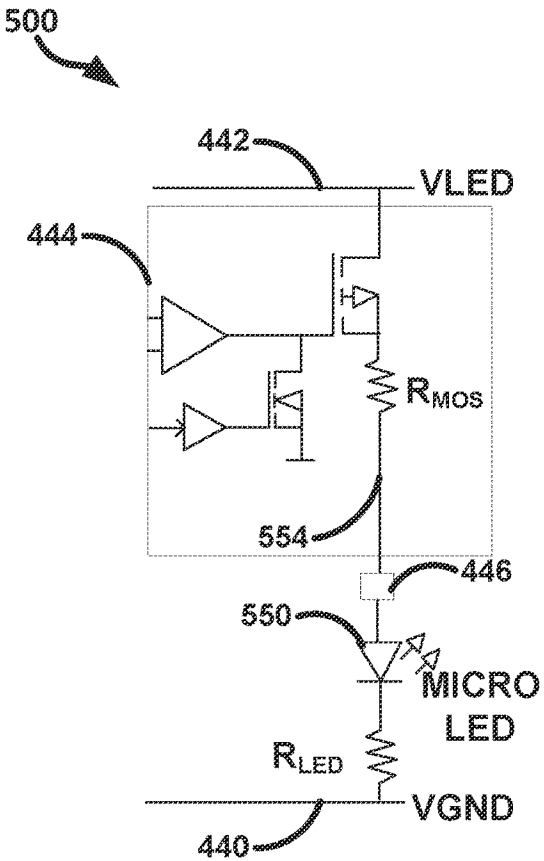
FIG. 5 illustrates, by way of example, a circuit diagram of an embodiment of a uLED pixel (uLED driver circuitry and a corresponding uLED).

FIG. 5 illustrates, by way of example, a logical circuit diagram of an embodiment of a system 500 that includes the uLED driver 444 and a uLED 550 of the matrix of uLEDs 104. The uLED driver 444 controls an electrical signal 554 on the electrical interconnect 446. The uLED driver 444, by controlling the electrical signal 554, can inhibit or allow current to flow to the uLED 550. Using this control, the uLED driver 444 can ultimately control whether and when the individual or group of uLEDs 550 is on and the duty cycle of the uLEDs.

To overcome the limitations of other uLED driving schemes and to increase electrical efficiency of a matrix of uLEDs 104, some improved driving schemes are provided. Embodiments consider uLED dies with individually addressable pixels. The uLED dies include uLED drivers 444 that include linear driver architectures operating in PWM mode. The control scheme(s) can help minimize the total root mean square (RMS) and harmonic current driven by the voltage supply 102, by at least in part, the phases of pulse width modulation (PWM) control signals of the uLEDs being randomized.

Embodiments can include a voltage supply 102, the output voltage of which can be dynamically modulated and controlled by a load (e.g., a controller 990 of the load (see FIG. 9)) with a sufficient bandwidth response. Embodiments can include a control scheme wherein outlier pixels can be identified (e.g. by means of a sensing voltage and classified as such (see FIG. 9)), before or during runtime of the matrix of uLEDs 104. The controller 990 can cause the voltage from the voltage supply 102 to increase to a specified voltage value during every cycle or every several cycles of the PWM signal of the drivers. The higher voltage can be specified as a function of a distribution of the forward voltages ($V_f$) of the outlier pixels.

Embodiments can include a control scheme that repeatedly (e.g., periodically, such as at predefined intervals) increases the voltage supply to a specified voltage value during every cycle or every several cycles of the PWM signal of the drivers. Said higher set voltage can be specified as a function of the forward voltage ($V_f$) of the outlier pixels. A forward voltage ($V_f$) of an LED is the voltage drop across the LED while the LED is illuminating.

Embodiments can include a control scheme wherein the random PWM phase control of the identified outlier pixels can be synchronized with an increase of the power supply voltage. Embodiments can include a control scheme to synchronize the rise of the voltage provided by the power supply with the PWM signals of the outlier pixels such that their compliance voltage can be satisfied at least during a period established by the increase in supply voltage. Embodiments can provide a control scheme that includes a modifiable set current of outlier pixels.

Figure 6:
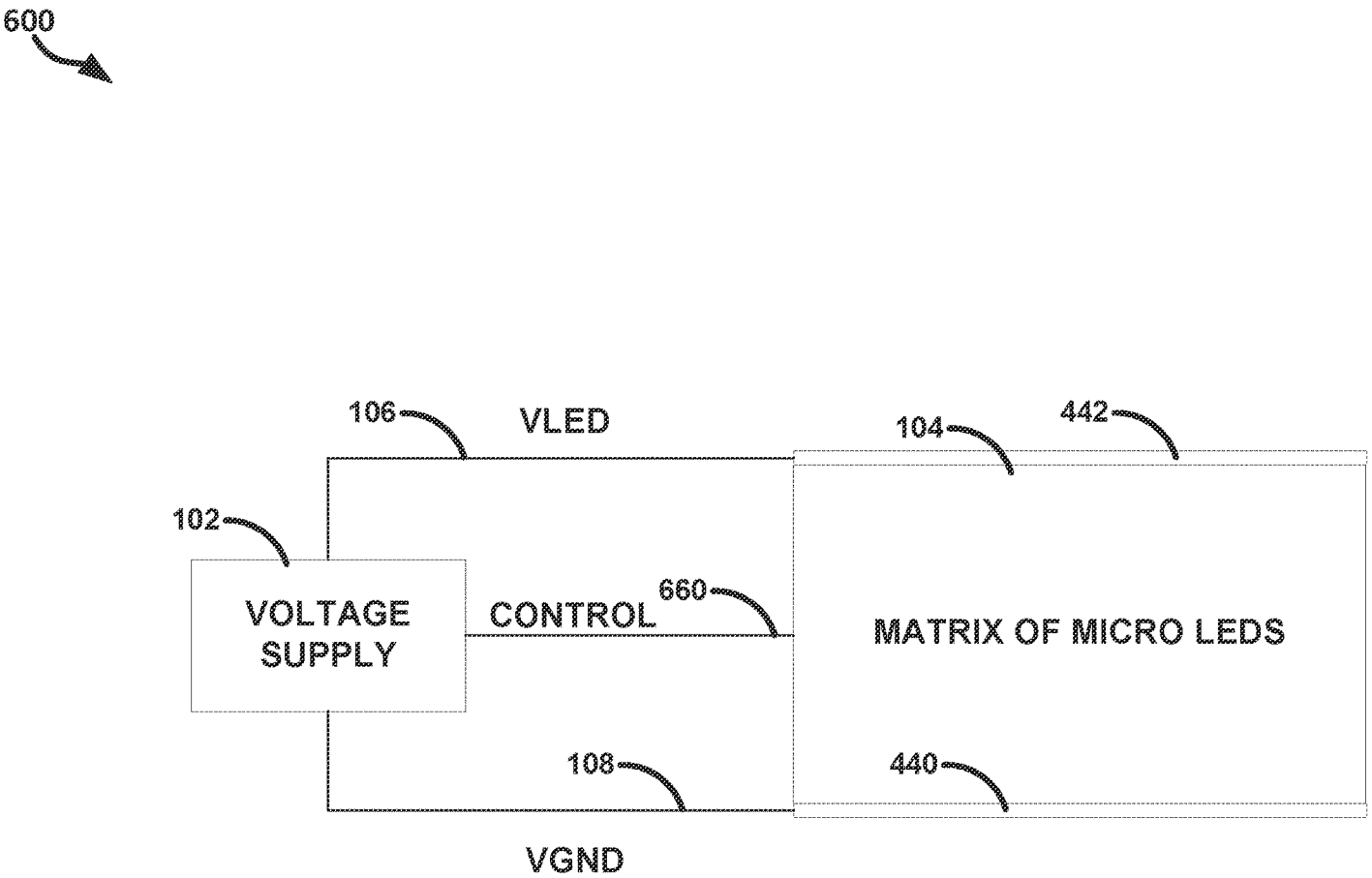
FIG. 6 illustrates, by way of example, a logical block diagram of an embodiment of a system that considers a forward voltage ($V_f$) of pixels in driving the uLEDs.

FIG. 6 illustrates, by way of example, a logical circuit diagram of an embodiment of a system 600 that considers outlier pixel $V_f$ to drive the matrix of uLEDs 104. The system 600 is similar to the uLED control system 100, with the system 600 including circuitry to provide a control command 660 to the voltage supply 102. The control command 660 indicates that the voltage supply 102 is to supply a higher voltage in a next voltage supply period. The control command 660 can be issued by a controller 990 (see FIG. 9) coupled to the uLED drivers 444 (see FIG. 4). The controller 990 can include a memory 988 or otherwise have access to a memory that includes data indicating $V_f$, duty cycle, PWM period, or the like for at least each uLED that has an abnormally high $V_f$ (e.g., a $V_f$ greater than a specified percentile or a number of standard deviations greater than an average $V_f$) The controller 990 can use this data to provide the command 660 that causes the supply 102 to increase the supply voltage to be higher than $V_f$. The timing of the control command 660 can be synchronized such that the voltage supply 102 increases the supply voltage $V_{LED}$ 106 during an on PWM portion of the outlier uLED.

Figure 7:
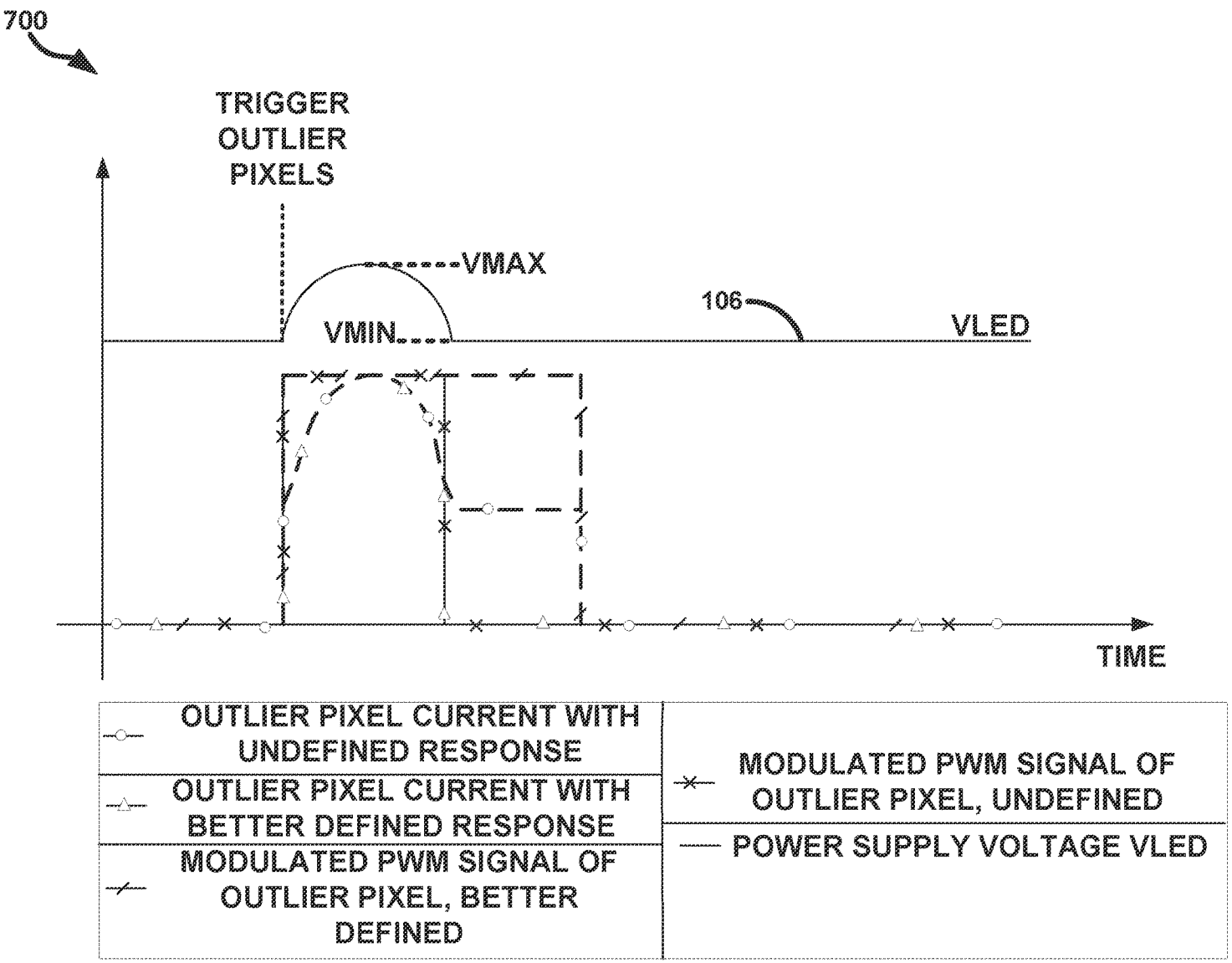
FIG. 7 illustrates, by way of example, a graph of various electrical LED characteristics over time.

FIG. 7 illustrates, by way of example, a graph 700 of various electric LED characteristics over time. The graph 700 plots voltage provided by the voltage supply 102 ($V_{LED}$). The voltage supply 102 is set, at minimum, to a compliance voltage that is greater than $V_f$ for a majority (e.g., greater than 50%, 60%, 70%, 80%, 90%, a greater percentage or a percentage therebetween) of the uLEDs in the matrix of uLEDS 104. The controller 990 can issue the command 660 to trigger activation of the outlier pixels. In response to the command 660, the voltage supply 102 can increase the supply voltage $V_{LED}$ from $V_{MIN}$ to $V_{MAX}$ (e.g., a highest forward voltage among all the uLEDs, a voltage set to be greater than a specified percentage of the uLEDs (e.g., greater than 75%, 80%, 85%, 90%, 95%, a greater percentage or a percentage therebetween). In moving from $V_{MIN}$ to $V_{MAX}$, the voltage can be sufficient to turn one or more of the outlier pixels during an on PWM period of the pixel.

Other electrical parameters shown in the graph 700 include outlier uLED current for an outlier uLED with an undefined voltage response. The voltage response is undefined when a voltage that is not greater than $V_f$. In such instances, the current can be about zero or float (be somewhere between zero and the current when the uLED is turned on).

FIGS. 6 and 7 show the basic operation of an embodiment in which the control command 660 from the matrix of uLEDs 104 is sent to the voltage supply 102. The voltage supply 102 in FIG. 6 thus include dynamic control bandwidth for establishing a modulated signal of about a same frequency as the uLED driver 444. With enough bandwidth, the voltage supply 102 can provide a voltage supply that's capable to swing the voltage between at least two levels ($V_{MIN}$ and $V_{MAX}$) within a PWM period, as depicted in FIG. 7. The low voltage level ($V_{MIN}$) corresponds to a voltage level without regard for outliers. The high voltage level is applied during a short period defined by a duty cycle of the voltage supply modulation signal. Such high voltage level is determined to guarantee voltage compliance of the outlier pixels during this short period. The duty cycle of the current driver may either coincide with the voltage supply, as indicated by triangle and "x" lines, or extend beyond this period, as indicated by slash and circle lines, in which case voltage compliance is not guaranteed and drive current will be undefined. Note that, as the voltage supply transitions between the two voltage levels, the rising and falling times will be dependent on the bandwidth response of the system, which will limit the shortest time of the high voltage level as well as the square shape quality of the PWM driver current.

Figure 8:
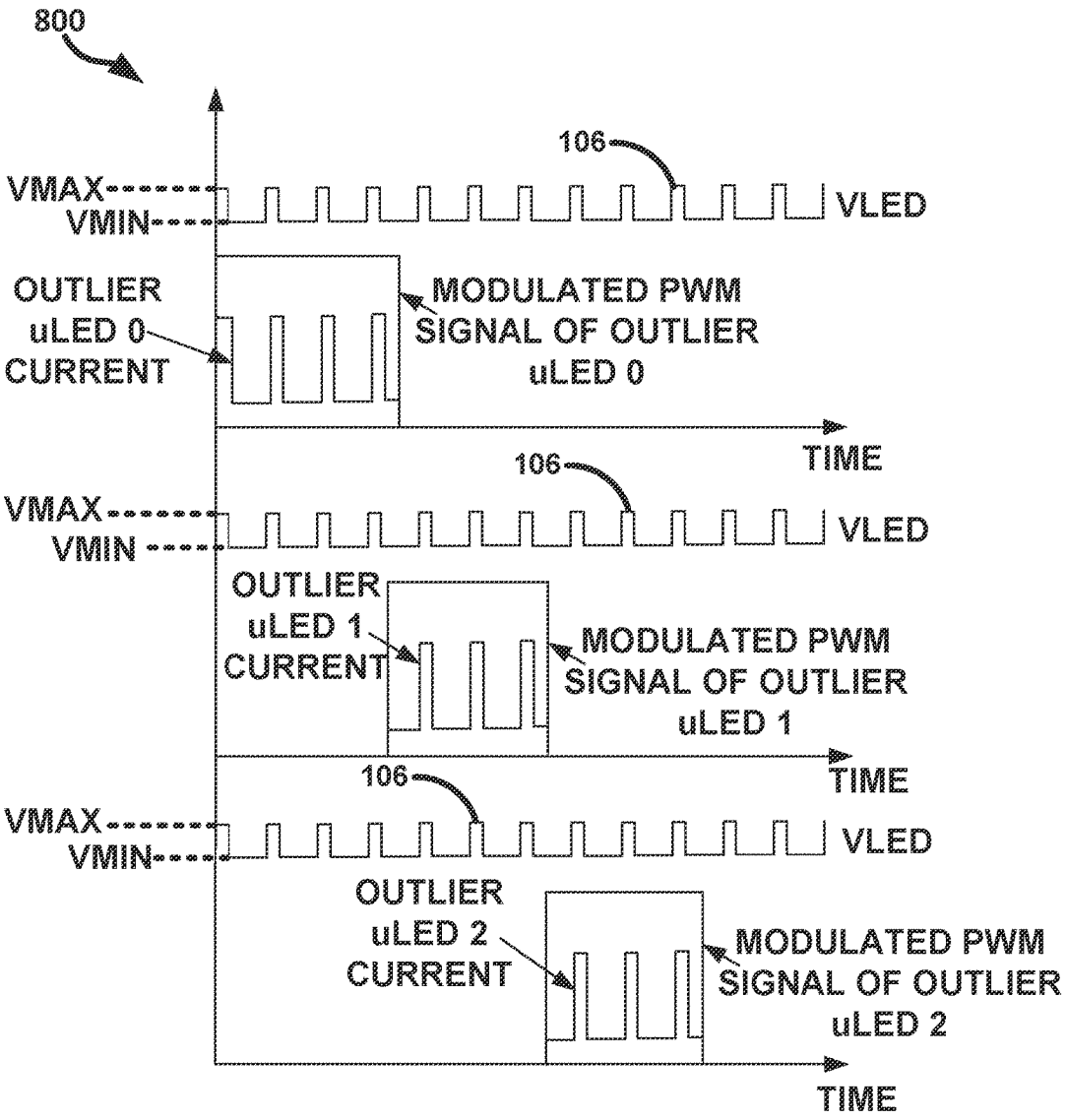
FIG. 8 illustrates, by way of example, a graph of an embodiment of a waveform from the voltage supply and corresponding response in a few uLEDs of the matrix of uLEDs over time.

FIG. 8 illustrates, by way of example, a graph 800 of an embodiment of a waveform from the voltage supply 102 and corresponding response in a few uLEDs of the matrix of uLEDs 104 over time. In a PWM driving scheme, only a portion of the uLEDs of the matrix of uLEDs 104 are driven at a given time. The time each uLED is driven is considered the PWM period of that uLED. As long as the time between on times of the uLEDs is sufficiently low (frequency is sufficiently high) a human eye will not perceive the off time and the color intensity appears as an average of the intensity over a time interval.

An advantage of using a power supply voltage as in FIG. 8 over the power supply voltage in FIG. 7 includes eliminating a need to synchronize a phase of the voltage power supply with a PWM on cycle of the uLED. For simplicity, FIG. 8 only illustrates three outlier pixels with their phases spread over the PWM period. In reality, there may be more such pixels with different phases, but the operation principle is similar.

The supply voltage $V_{LED}$ 106 alternates between the $V_{MIN}$ and $V_{MAX}$ values at a frequency higher than the pixel PWM frequency. That is, for each PWM on period, the $V_{LED}$ 106 goes through multiple cycles between $V_{MIN}$ and $V_{MAX}$. Consequently, for an outlier pixel with a specified duty cycle value, even though the phase of the supply voltage $V_{LED}$ 106 and the pixel's PWM are not synchronized, the pixel current can largely follow the pattern of the supply voltage $V_{LED}$ 106 in a way similar to the method described for FIG. 6. The resulted average pixel current can be similar to that of an embodiment operating in accord with FIG. 6.

In FIG. 8, each uLED is illustrated having about a same duty cycle, however this is not required. The pixels can have a variety of duty cycles and still operate well. Although the pixels have different PWM phases, they all are subject to several occurrences of high supply voltage within the high period of their respective PWM signal. The higher the frequency of the supply voltage $V_{LED}$ 106, the more often the phase of the uLED and the $V_{max}$ will correspond. and the more accurate average pixel current. For a pixel with a sufficiently small duty cycle and a sufficiently high $V_f$, it is possible that the uLED may not turn on due to no overlapping between the high supply voltage ($V_{MAX}$) and the high frequency pixel PWM signal. Nevertheless, because the difference between a zero current and a small current is still small, the impact of such extinguishment (an inability for the uLED to turn on) on the displayed image or the total current of the array of uLEDs 104 can be limited. The duty cycle threshold for extinguishment depends on the alternating frequency (1/time between $V_{MIN}$ and $V_{MAX}$) and the PWM on period (duty cycle) of the uLED. The higher the frequency, the smaller said duty cycle threshold and the less impact of the extinguishment.

Figure 9:
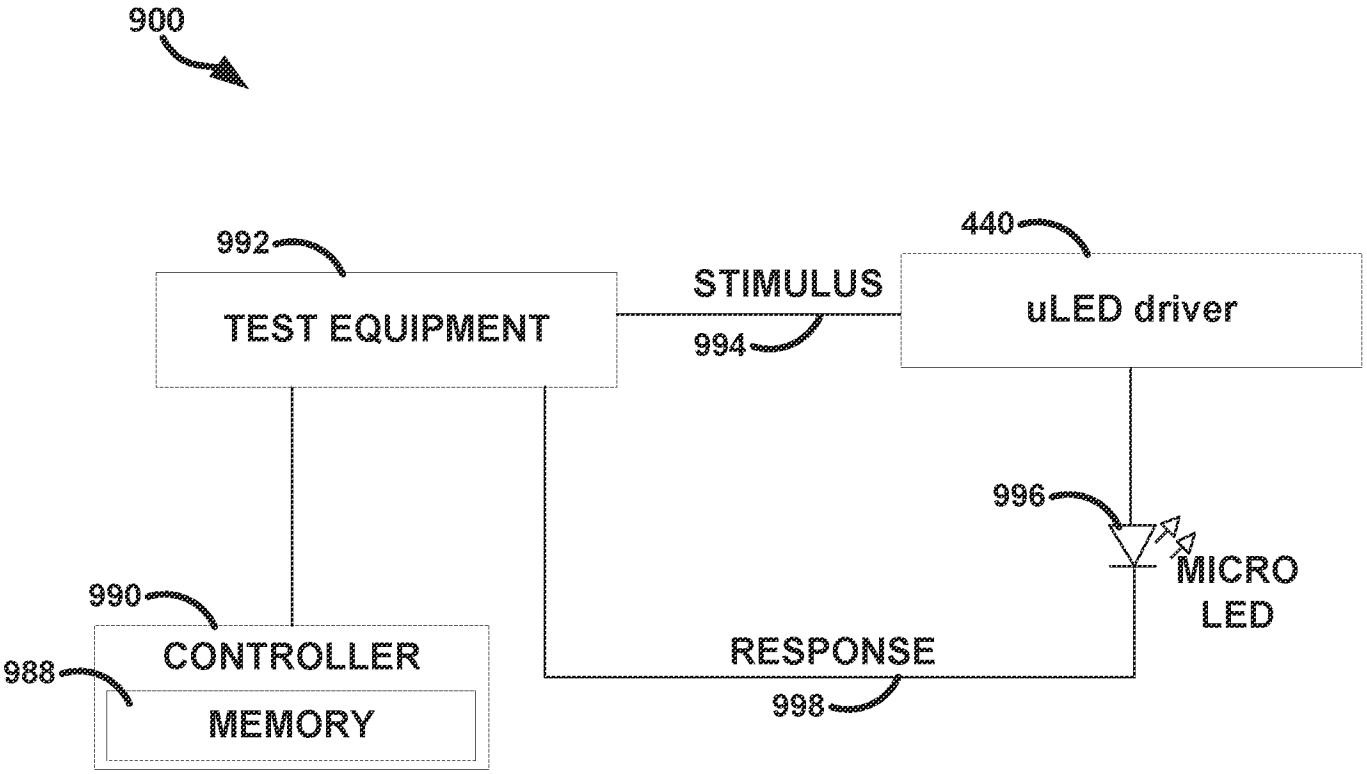
FIG. 9 illustrates, by way of example, a conceptual block diagram of an embodiment of a uLED forward voltage ($V_f$) analysis system.

FIG. 9 illustrates, by way of example, a diagram of an embodiment of a system 900 for analysing a forward voltage ($V_f$) of uLEDs of a uLED die. To use embodiments, and as discussed, a controller 990 can be used as part of the matrix of uLEDs 104. The controller 990 can include a memory 988. The memory 988 can store data indicating which uLEDs have an abnormally high $V_f$. To determine whether a uLED 996 has an abnormally high $V_f$, an electrical stimulus 994 can be provided to the uLED driver 444 by test equipment 992. The test equipment 992 can include an electrical power supply, similar to the power supply 102. The test equipment 992 can be operable to vary an amplitude, frequency, or other parameter of a current or voltage supplied as the stimulus 994.

The stimulus 994 can include a voltage that is going to be used to drive the uLED driver 444 most of the time ($V_{MIN}$). If a response 998 that is sufficient is detected, the uLED 996 can be considered normal. If a response 998 that is insufficient is detected, the uLED 996 can be considered an outlier.

In response to a response 998 that is insufficient (a current below an expected (threshold) current) the test equipment 992 can cause an identification of the uLED 996 (e.g., by position in the matrix of uLEDs, such as by row and column, or other identification) to be stored in the memory 988 of the controller 990 (or a memory accessible by the controller 990). That way the controller 990 can determine when to issue the command 660 to increase the supply voltage $V_{LED}$ 106. The operations of FIG. 9 can be performed during fabrication, after packaging, or during some other phase of manufacturing or distribution, or a combination thereof.

The controller 990 can include electric or electronic components configured to perform operations thereof. The electric or electronic components can include one or more transistors, resistors, capacitors, diodes, inductors, oscillators, switches, logic gates (e.g., AND, OR, XOR, negate, buffer, or the like), multiplexers, analog to digital converters, digital to analog converters, amplifiers, rectifiers, modulators, demodulators, processors (e.g., central processing units (CPUs), graphics processing units (GPUs), application specific integrated circuits (ASICs), field programmable gate arrays (FPGAs), or the like), memory devices (e.g., random access memory (RAM), read only memory (ROM), or the like), or the like.

Figure 10:
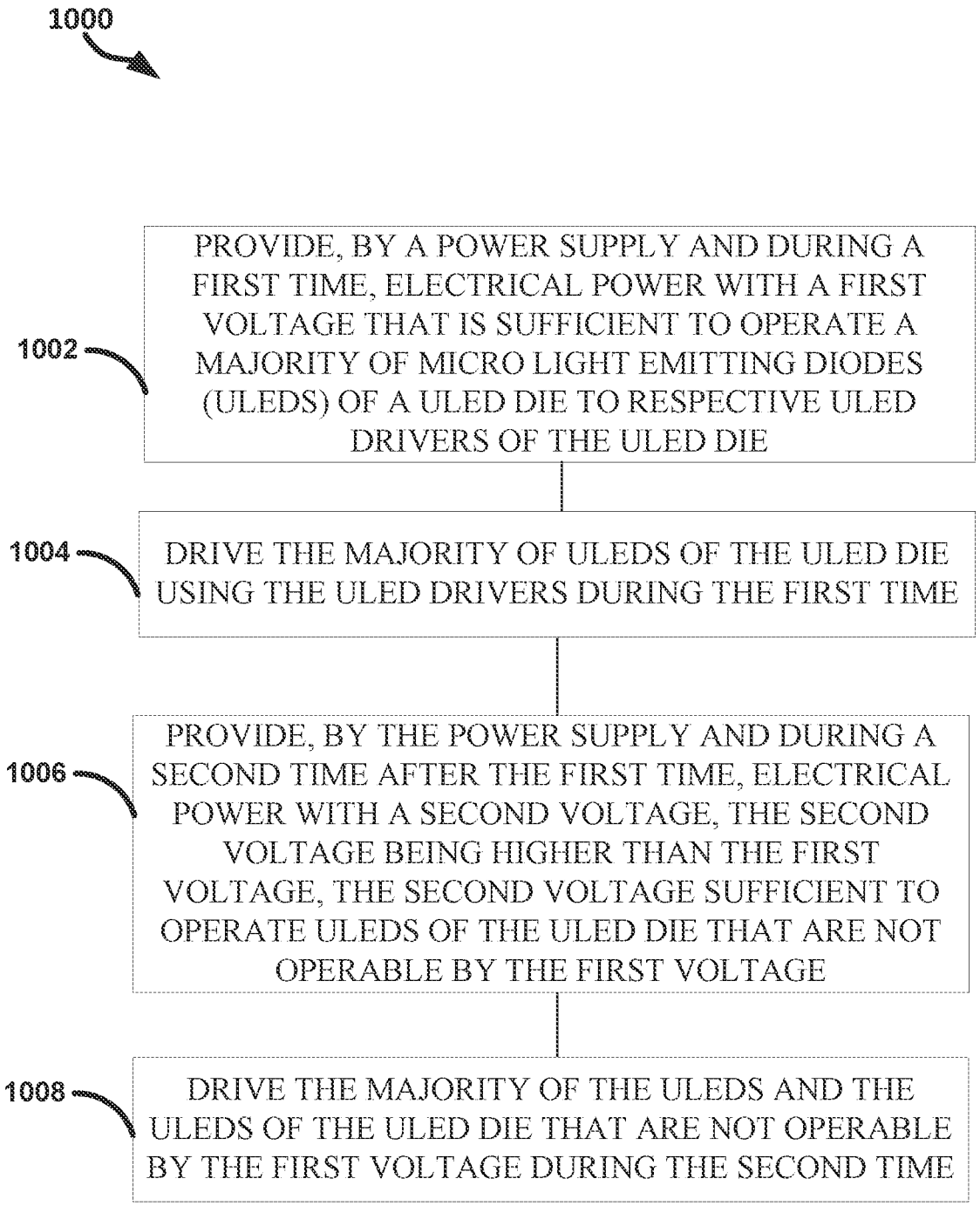
FIG. 10 illustrates, by way of example, a diagram of an embodiment of a method for driving a uLED matrix die.

The driver 444 can include electrical or electronic components configured to implement power provision to the uLED(s) of the matrix of uLEDs 104 (sometimes called the uLED die). The electric or electronic components can include one or more transistors, resistors, capacitors, diodes, inductors, oscillators, switches, logic gates, multiplexers, analog to digital converters, digital to analog converters, amplifiers, rectifiers, modulators, demodulators, processors, memory devices, or the like FIG. 10 illustrates, by way of example, a diagram of an embodiment of a method 1000 for driving a uLED matrix die. The method 1000 can be performed, at least in part, by the voltage supply 102, the matrix of uLEDs 104, the controller 990, driver 444, other component, or a combination thereof. The method 1000, as illustrated, includes providing, by a power supply and during a first time, electrical power with a first voltage that is sufficient to operate a majority of micro light emitting diodes (uLEDs) of a uLED die to respective uLED drivers of the uLED die, at operation 1002; driving the majority of uLEDs of the uLED die using the uLED drivers during the first time, at operation 1004; providing, by the power supply and during a second time after the first time, electrical power with a second voltage, the second voltage being higher than the first voltage, the second voltage sufficient to operate uLEDs of the uLED die that are not operable by the first voltage, at operation 1006; and driving the majority of the uLEDs and the uLEDs of the uLED die that are not operable by the first voltage during the second time, at operation 1008.

The method 800 can further include, wherein the second time is in sync with a pulse width modulation (PWM) on period of a uLED of the uLEDs that are not operable by the first voltage. The method can further include testing, by test equipment, each uLED of the uLED die to determine whether the uLED is operable by the first voltage. The method 800 can further include storing, in a memory accessible by a controller of the uLED die, data indicating an identification (ID) of each uLED of the uLED die that is not operable by the first voltage.

The method 800 can further include issuing, by the controller, a command to the power supply that causes the power supply to provide electrical power at the second voltage. The method 800 can further include during a single pulse width modulation (PWM) on period of a uLED Of the uLEDs that are not operable by the first voltage, providing, by the power supply, electrical power at the first voltage and the second voltage a plurality of times. The method 800 can further include providing, by the power supply, the second voltage during every pulse width modulation cycle on time of a uLED that is not operable by the first voltage.

The method 800 can further include providing, by the power supply, the second voltage during less than all of pulse width modulation (PWM) on times of a uLED that is not operable by the first voltage. The method 800 can further include, wherein a drive current of the uLEDs of the uLED die that are not operable by the first voltage is individually modified such that an average drive current of the uLED is driven to a target average power.

What follows are some details regarding the matrix of uLEDs 104 and some application considerations followed by some examples.

Figure 11:
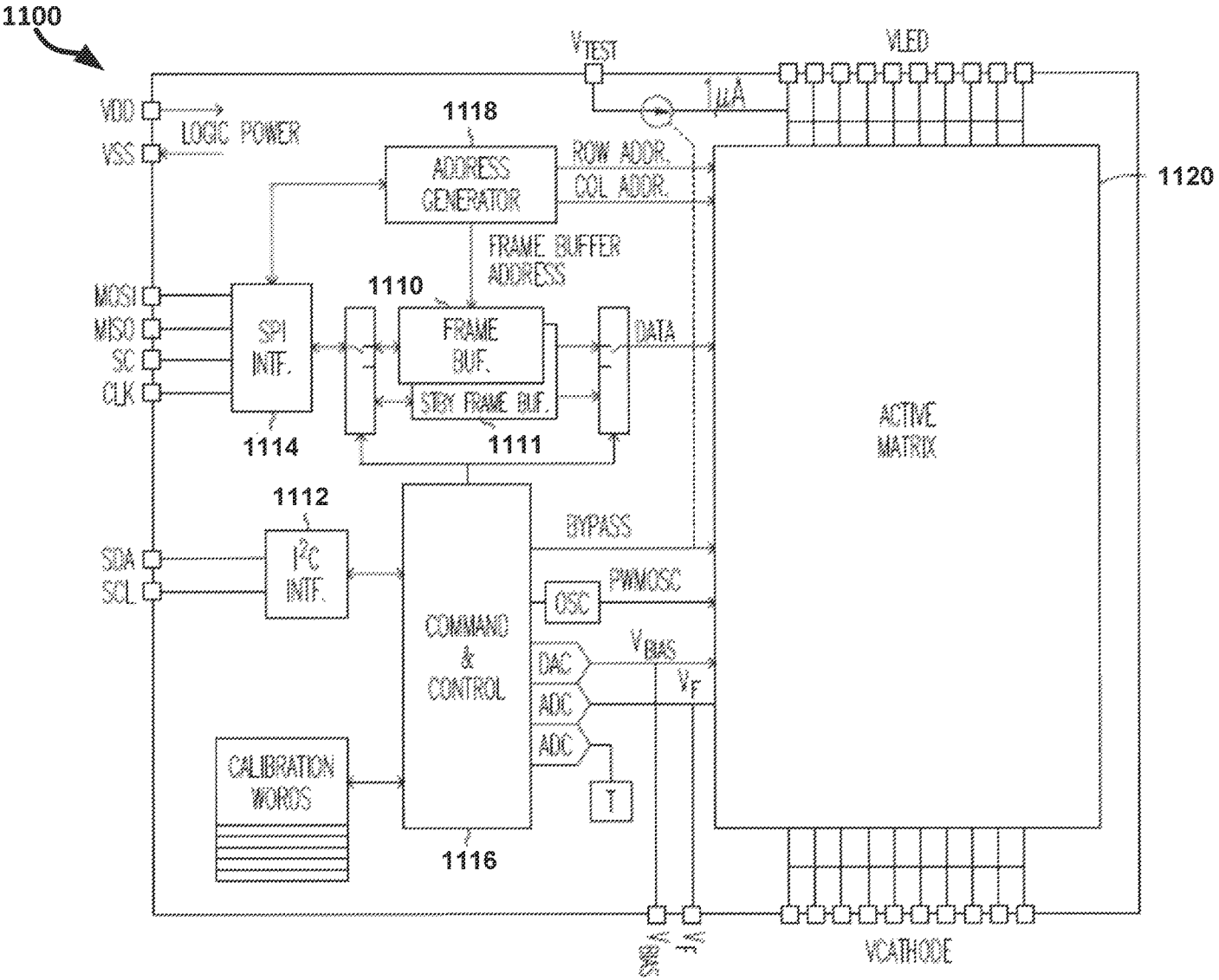
FIG. 11 illustrates, by way of example, a diagram of an embodiment of a chip-level implementation of a system supporting functionality, such as discussed, for example, regarding FIGS. 6-10 below.

FIG. 11 illustrates in more detail an embodiment of a chip-level implementation of a system 1100 supporting functionality, such as discussed with respect to, for example, FIGS. 6-10. The system 1100 includes a command and control module 1116 (sometimes called the controller, which may be similar to or the same as the controller 990 of FIG. 9) able to implement pixel or group pixel level control of amplitude and duty cycle for circuitry and procedures such as discussed with respect to FIGS. 6-10 and elsewhere herein. In some embodiments, the system 1100 further includes a frame buffer 1110 for holding generated or processed images that can be supplied to the matrix of uLEDs 1120. Other modules can include digital control interfaces, such as a serial bus (e.g., an Inter-Integrated Circuit ($I^2C$) serial bus) or Serial Peripheral Interface (SPI) (1114), that are configured to transmit control data or instructions or response data.

In operation, system 1100 can accept image or other data from a vehicle or other source that arrives via the SPI interface 1114. Successive images or video data can be stored in an image frame buffer 1110. If no image data is available, one or more standby images held in a standby image buffer 1111 can be directed to the image frame buffer 1110. Such standby images can include, for example, an intensity and spatial pattern consistent with legally allowed low beam headlamp radiation patterns of a vehicle, or default light radiation patterns for architectural lighting or displays.

In operation, pixels in the images are used to define response of corresponding LED pixels in the active, with intensity and spatial modulation of LED pixels being based on the image(s). To reduce data rate issues, groups of pixels (e.g., 5×5 blocks) can be controlled as single blocks in some embodiments. In some embodiments, high speed and high data rate operation is supported, with pixel values from successive images able to be loaded as successive frames in an image sequence at a rate between 30 Hz and 100 Hz, with 60 Hz being typical. PWM can be used to control each pixel to emit light in a pattern and with an intensity at least partially dependent on the image held in the image frame buffer 1110.

In some embodiments, the system 1100 can receive logic power via $V_{dd}$ and $V_{ss}$ pins. An active matrix receives power for LED array control by multiple VLED and $V_{Cathode}$ pins. The SPI 1114 can provide full duplex mode communication using a master-slave architecture with a single master. The master device originates the frame for reading and writing. Multiple slave devices are supported through selection with individual slave select (SS) lines. Input pins can include a Master Output Slave Input (MOSI), a Master Input Slave Output (MISO), a chip select (SC), and clock (CLK), all connected to the SPI interface 1114. The SPI interface 1114 connects to an address generator, frame buffer, and a standby frame buffer. Pixels can have parameters set and signals or power modified (e.g. by power gating before input to the frame buffer, or after output from the frame buffer via pulse width modulation or power gating) by a command and control module. The SPI interface 1114 can be connected to an address generation module 1118 that in turn provides row and address information to the active matrix 1120. The address generation module 1118 in turn can provide the frame buffer address to the frame buffer 1110.

In some embodiments, the command and control module 1116 can be externally controlled via the serial bus 1112. A clock (SCL) pin and data (SDA) pin, such as with 7-bit addressing can be supported. The command and control module 1116 can include a digital to analog converter (DAC) and two analog to digital converters (ADC). The DAC and ADCs are respectively used to set $V_{bias}$ for a connected active matrix, help determine maximum $V_f$, and determine system temperature. Also connected are an oscillator (OSC) to set the pulse width modulation oscillation (PWMOSC) frequency for the active matrix 1120. In one embodiment, a bypass line is also present to allow address of individual pixels or pixel blocks in the active matrix for diagnostic, calibration, or testing purposes. The active matrix 1120 can be further supported by row and column select that is used to address individual pixels, which are supplied with a data line, a bypass line, a PWMOSC line, a $V_{bias}$ line, and a $V_f$ line.

As will be understood by a person of ordinary skill in the art, in some embodiments the described circuitry and active matrix 1120 can be packaged and optionally include a submount or printed circuit board connected for powering and controlling light production by the semiconductor LED. In certain embodiments, the printed circuit board can also include electrical vias, heat sinks, ground planes, electrical traces, and flip chip or other mounting systems. The submount or printed circuit board may be formed of any suitable material, such as ceramic, silicon, aluminum, etc. If the submount material is conductive, an insulating layer is formed over the substrate material, and the metal electrode pattern is formed over the insulating layer. The submount can act as a mechanical support, providing an electrical interface between electrodes on the LED and a power supply, and also provide heat sinking.

In some embodiments, the active matrix 1120 can be formed from light emitting elements of various types, sizes, and layouts. In one embodiment, one or two dimensional matrix arrays of individually addressable light emitting diodes (LEDs) can be used. Commonly N×M arrays where N and M are respectively between two and one thousand, can be used. Individual LED structures can have a square, rectangular, hexagonal, polygonal, circular, arcuate or other surface shape. Arrays of the LED assemblies or structures can be arranged in geometrically straight rows and columns, staggered rows or columns, curving lines, or semi-random or random layouts. LED assemblies can include multiple LEDs formed as individually addressable pixel arrays are also supported. In some embodiments, radial or other non-rectangular grid arrangements of conductive lines to the LED can be used. In other embodiments, curving, winding, serpentine, and/or other suitable non-linear arrangements of electrically conductive lines to the LEDs can be used.

In some embodiments, arrays of microLEDs (μLEDs or uLEDs) can be used. uLEDs can support high density pixels having a lateral dimension less than 100 μm by 100 μm. In some embodiments, uLEDs with dimensions of about 50 μm in diameter or width and smaller can be used. Such uLEDS can be used for the manufacture of color displays by aligning, in close proximity, uLEDs comprising red, blue, and green wavelengths. In other embodiments, uLEDS can be defined on a monolithic gallium nitride (GaN) or other semiconductor substrate, formed on segmented, partially, or fully divided semiconductor substrate, or individually formed or panel assembled as groupings of uLEDs. In some embodiments, the active matrix 1120 can include small numbers of uLEDs positioned on substrates that are centimeter scale area or greater. In some embodiments, the active matrix 1120 can support uLED pixel arrays with hundreds, thousands, or millions of LEDs positioned together on centimeter scale area substrates or smaller. In some embodiments, uLEDS can include LEDs sized between 30 microns and 500 microns. In some embodiments, each of the light emitting pixels in the light emitting pixel array can be positioned at least 1 millimeter apart to form a sparse LED array. In other embodiments sparse LED arrays of light emitting pixels can be positioned less than 1 millimeter apart and can be spaced apart by distances ranging from 30 microns to 500 microns. The LEDs can be embedded in a solid or a flexible substrate, which can be at least in part transparent. For example, the light emitting pixel arrays can be at least partially embedded in glass, ceramic, or polymeric materials.

Light emitting matrix pixel arrays, such as discussed herein, may support applications that benefit from fine-grained intensity, spatial, and temporal control of light distribution. This may include, but is not limited to, precise spatial patterning of emitted light from pixel blocks or individual pixels. Depending on the application, emitted light may be spectrally distinct, adaptive over time, and/or environmentally responsive. The light emitting pixel arrays may provide pre-programmed light distribution in various intensity, spatial, or temporal patterns. The emitted light may be based at least in part on received sensor data and may be used for optical wireless communications. Associated optics may be distinct at a pixel, pixel block, or device level. An example light emitting pixel array may include a device having a commonly controlled central block of high intensity pixels with an associated common optic, whereas edge pixels may have individual optics. Common applications supported by light emitting pixel arrays include video lighting, automotive headlights, architectural and area illumination, street lighting, and informational displays.

Light emitting matrix pixel arrays may be used to selectively and adaptively illuminate buildings or areas for improved visual display or to reduce lighting costs. In addition, light emitting pixel arrays may be used to project media facades for decorative motion or video effects. In conjunction with tracking sensors and/or cameras, selective illumination of areas around pedestrians may be possible. Spectrally distinct pixels may be used to adjust the color temperature of lighting, as well as support wavelength specific horticultural illumination.

Street lighting is an application that may benefit from use of light emitting pixel arrays. A single light emitting array may be used to mimic various street light types, allowing, for example, switching between a Type I linear streetlight and a Type IV semicircular streetlight by appropriate activation or deactivation of selected pixels. In addition, street lighting costs may be lowered by adjusting light beam intensity or distribution according to environmental conditions or time of use. For example, light intensity and area of distribution may be reduced when pedestrians are not present. If pixels of the light emitting pixel array are spectrally distinct, the color temperature of the light may be adjusted according to respective daylight, twilight, or night conditions.

Light emitting arrays are also suited for supporting applications requiring direct or projected displays. For example, warning, emergency, or informational signs may all be displayed or projected using light emitting arrays. This allows, for example, color changing or flashing exit signs to be projected. If a light emitting array is composed of a large number of pixels, textual or numerical information may be presented. Directional arrows or similar indicators may also be provided.

Vehicle headlamps are a light emitting array application that requires large pixel numbers and a high data refresh rate. Automotive headlights that actively illuminate only selected sections of a roadway can used to reduce problems associated with glare or dazzling of oncoming drivers. Using infrared cameras as sensors, light emitting pixel arrays activate only those pixels needed to illuminate the roadway, while deactivating pixels that may dazzle pedestrians or drivers of oncoming vehicles. In addition, off-road pedestrians, animals, or signs may be selectively illuminated to improve driver environmental awareness. If pixels of the light emitting pixel array are spectrally distinct, the color temperature of the light may be adjusted according to respective daylight, twilight, or night conditions. Some pixels may be used for optical wireless vehicle to vehicle communication.

An LED light module can include matrix LEDS, alone or in conjunction with primary or secondary optics, including lenses or reflectors. To reduce overall data management requirements, the light module can be limited to on/off functionality or switching between relatively few light intensity levels. Full pixel level control of light intensity is not necessarily supported.

In operation, pixels in the images are used to define response of corresponding LED pixels in the pixel module, with intensity and spatial modulation of LED pixels being based on the image(s). To reduce data rate issues, groups of pixels (e.g. 5×5 blocks) can be controlled as single blocks in some embodiments. High speed and high data rate operation is supported, with pixel values from successive images able to be loaded as successive frames in an image sequence at a rate between 30 Hz and 100 Hz, with 60 Hz being typical. In conjunction with a pulse width modulation module, each pixel in the pixel module can be operated to emit light in a pattern and with intensity at least partially dependent on the image held in the image frame buffer.

Figure 12:
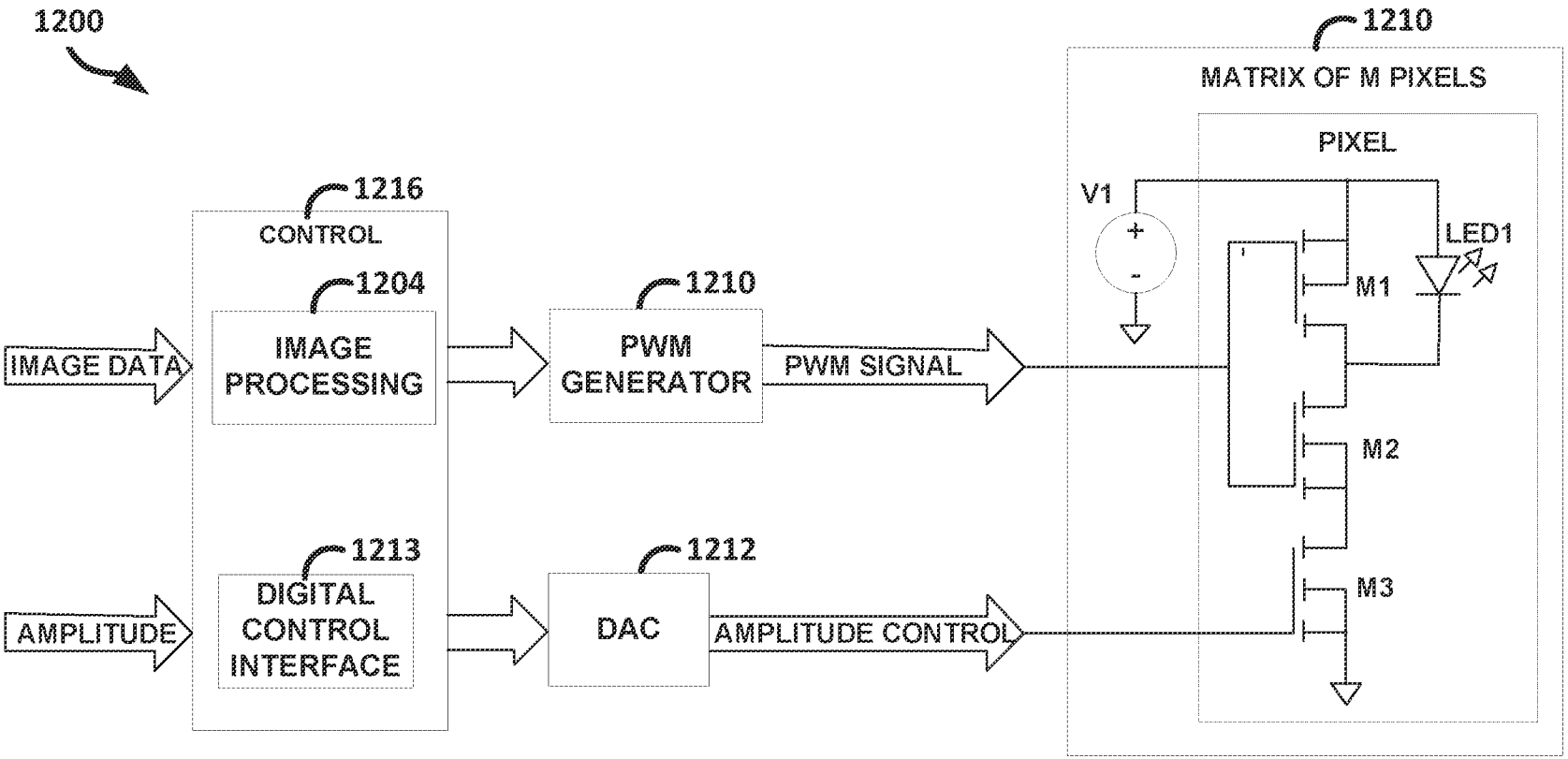
FIG. 12 illustrates, by way of example, a diagram of an embodiment of circuitry included in a uLED package.

In the foregoing described embodiments, intensity of a uLED can be separately controlled and adjusted by setting appropriate ramp times and pulse width for each LED pixel using a suitable lighting logic, control module, and/or PWM module. Outlier pixel voltage management can provide LED pixel activation to provide reliable patterned lighting. A control system 1200 that can provide power supply 102 voltage management is illustrated in FIG. 12. As seen in FIG. 12, a matrix micro-LED array 1220 can contain one or more arrays of thousands to millions of microscopic LED pixels that actively emit light and are individually controlled. To emit light in a pattern or sequence that results in display of an image, the current levels of the micro-LED pixels at different locations on an array are adjusted individually according to a specific image. This can involve a PWM, which turns on and off the pixels at a certain frequency. During PWM operation, the average DC current through a pixel is the product of the electrical current amplitude and the PWM duty cycle, which is the ratio between the conduction time and the period or cycle time.

FIG. 12 illustrates, by way of example, a logical block diagram of a system 1200 that includes circuitry that can be included in a uLED package. Processing modules that facilitate efficient usage of the system 1200 are illustrated in FIG. 12. The system 1200 includes a control module 1216 able to implement pixel or group pixel level control of amplitude and duty cycle for circuitry and procedures such as discussed with respect to FIGS. 6-11. In some embodiments, the system 1200 further includes an image processing module 1204 to generate, process, or transmit an image, and digital control interfaces 1213, such as inter-integrated circuit (I2C), serial peripheral interface (SPI), controller area network (CAN), universal asynchronous receiver transmitter (UART), or the like, that is configured to transmit control data and/or instructions. The digital control interfaces 1213 and control module 1116 may include a system microcontroller and any type of wired or wireless module configured to receive a control input from an external device. By way of example, a wireless module may include Bluetooth®, Zigbee, Z-wave, mesh, WiFi, near field communication (NFC) and/or peer to peer modules may be used. The microcontroller may be any type of special purpose computer or processor that may be embedded in an LED lighting system and configured or configurable to receive inputs from the wired or wireless module or other modules in the LED system and provide control signals to other modules based thereon. Algorithms implemented by the microcontroller or other suitable control module 1116 may be implemented in a computer program, software, or firmware incorporated in a non-transitory computer-readable storage medium for execution by the special purpose processor. Examples of non-transitory computer-readable storage mediums include a read only memory (ROM), a random access memory (RAM), a register, cache memory, and semiconductor memory devices. The memory may be included as part of the microcontroller or may be implemented elsewhere, either on or off a printed circuit or electronics board The term module, as used herein, may refer to electrical and/or electronic components disposed on individual circuit boards that may be soldered to one or more electronics boards. The term module may, however, also refer to electrical and/or electronic components that provide similar functionality, but which may be individually soldered to one or more circuit boards in a same region or in different regions.

The control module 1216 can further include the image processing module 1204 and the digital control interfaces 1213 such as $I^2C$. As will be appreciated, in some embodiments an image processing computation may be done by the control module 1116 through directly generating a modulated image. Alternatively, a standard image file can be processed or otherwise converted to provide modulation to match the image. Image data that mainly contains PWM duty cycle values can be processed for all pixels in image processing module 1204. Since amplitude is a fixed value or rarely changed value, amplitude related commands can be given separately through a simpler digital interface, such as $I^2C$. The control module 1216 interprets digital data, which can be used by PWM generator 1210 to generate PWM signals for pixels, and by Digital-to-Analog Converter (DAC) block 1212 to generate the control signals for obtaining the required current source amplitude.

In some embodiments, the active matrix 1220 in FIG. 12 can include m pixels including m common anode LEDs. In one example embodiment the pixel unit includes a single LED, LED1, and three transconductance device (e.g., MOSFET) switches M1 through M3, and is supplied by the power supply V1 (sometimes called $V_{LED}$). M3 is an N-channel metal oxide semiconductor field effect transistor (MOSFET) whose gate is coupled to the amplitude control signal to generate the required current source amplitude. The P-channel MOSFET M1 is in parallel to LED1 and forms a totem pole pair with the N-channel MOSFET M2. The gates of the M1 and M2 transistor pair are tied together and coupled to the PWM signal. Therefore, when PWM is high, M1 will be turned off and M2 will be turned on. A current will flow through LED1, M2, and M3 with a value determined by the amplitude control signal coupled to M3 gate. When PWM is low, M1 will be turned on and M2 will be turned off. Consequently, the current source of M3 will be cut off and the LED will be fast discharged through M1.

Figure 13:
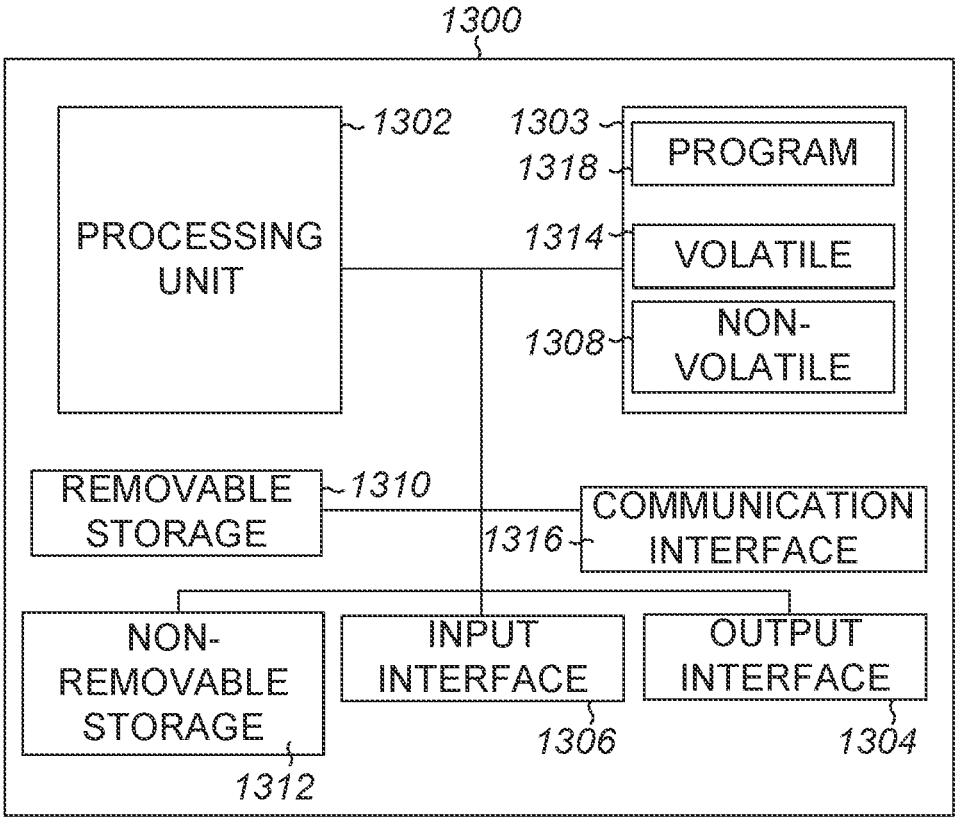
FIG. 13 illustrates, by way of example, a block diagram of an embodiment of a machine 1300 (e.g., a computer system) to implement one or more embodiments.

FIG. 13 illustrates, by way of example, a block diagram of an embodiment of a machine 1300 (e.g., a computer system) to implement one or more embodiments. The machine 1300 can implement a technique for managing underdriven or undriven uLEDs of a uLED die. The controller 990, test equipment 992, voltage supply 102, or a component thereof can include one or more of the components of the machine 1300. One or more of the controller 990, test equipment 992, voltage supply 102, or a component thereof can be implemented, at least in part, using a component of the machine 1300. One example machine 1300 (in the form of a computer), may include a processing unit 1302, memory 1303, removable storage 1310, and non-removable storage 1312. Although the example computing device is illustrated and described as machine 1300, the computing device may be in different forms in different embodiments. For example, the computing device may instead be a smartphone, a tablet, smartwatch, or other computing device including the same or similar elements as illustrated and described regarding FIG. 13. Devices such as smartphones, tablets, and smartwatches are generally collectively referred to as mobile devices. Further, although the various data storage elements are illustrated as part of the machine 1300, the storage may also or alternatively include cloud-based storage accessible via a network, such as the Internet.

Memory 1303 may include volatile memory 1314 and non-volatile memory 1308. The machine 1300 may include—or have access to a computing environment that includes—a variety of computer-readable media, such as volatile memory 1314 and non-volatile memory 1308, removable storage 1310 and non-removable storage 1312. Computer storage includes random access memory (RAM), read only memory (ROM), erasable programmable read-only memory (EPROM) & electrically erasable programmable read-only memory (EEPROM), flash memory or other memory technologies, compact disc read-only memory (CD ROM), Digital Versatile Disks (DVD) or other optical disk storage, magnetic cassettes, magnetic tape, magnetic disk storage or other magnetic storage devices capable of storing computer-readable instructions for execution to perform functions described herein.

The machine 1300 may include or have access to a computing environment that includes input 1306, output 1304, and a communication connection 1316. Output 1304 may include a display device, such as a touchscreen, that also may serve as an input device. The input 1306 may include one or more of a touchscreen, touchpad, mouse, keyboard, camera, one or more device-specific buttons, one or more sensors integrated within or coupled via wired or wireless data connections to the machine 1300, and other input devices. The computer may operate in a networked environment using a communication connection to connect to one or more remote computers, such as database servers, including cloud-based servers and storage. The remote computer may include a personal computer (PC), server, router, network PC, a peer device or other common network node, or the like. The communication connection may include a Local Area Network (LAN), a Wide Area Network (WAN), cellular, Institute of Electrical and Electronics Engineers (IEEE) 802.11 (Wi-Fi), Bluetooth, or other networks.

Computer-readable instructions stored on a computer-readable storage device are executable by the processing unit 1302 (sometimes called processing circuitry) of the machine 1300. A hard drive, CD-ROM, and RAM are some examples of articles including a non-transitory (e.g., tangible) computer-readable medium such as a storage device. For example, a computer program 1318 may be used to cause processing unit 1302 to perform one or more methods or algorithms described herein. Note that the term "non-transitory" should not be interpreted to mean that the medium or storage device is incapable of movement.

To further illustrate the apparatus and related method disclosed herein, a non-limiting list of examples is provided below. Each of the following non-limiting examples can stand on its own or can be combined in any permutation or combination with any one or more of the other examples.

In Example 1 a method can include providing, by a power supply and during a first time, electrical power with a first voltage that is sufficient to operate a majority of micro light emitting diodes (uLEDs) of a uLED die to respective uLED drivers of the uLED die, driving the majority of uLEDs of the uLED die using the uLED drivers during the first time, providing, by the power supply and during a second time after the first time, electrical power with a second voltage, the second voltage being higher than the first voltage, the second voltage sufficient to operate uLEDs of the uLED die that are not operable by the first voltage, and driving the majority of the uLEDs and the uLEDs of the uLED die that are not operable by the first voltage during the second time.

In Example 2, Example 1 can further include, wherein the second time is in sync with a pulse width modulation (PWM) on period of a uLED of the uLEDs that are not operable by the first voltage.

In Example 3, Example 2 can further include testing, by test equipment, each uLED of the uLED die to determine whether the uLED is operable by the first voltage, and storing, in a memory accessible by a controller of the uLED die, data indicating an identification (ID) of each uLED of the uLED die that is not operable by the first voltage.

In Example 4, Example 3 can further include issuing, by the controller, a command to the power supply that causes the power supply to provide electrical power at the second voltage.

In Example 5, at least one of Examples 1-4 can further include, during a single pulse width modulation (PWM) on period of a uLED Of the uLEDs that are not operable by the first voltage, providing, by the power supply, electrical power at the first voltage and the second voltage a plurality of times.

In Example 6, at least one of Examples 1-5 can further include providing, by the power supply, the second voltage during every pulse width modulation cycle on time of a uLED that is not operable by the first voltage.

In Example 7, at least one of Examples 1-6 can further include providing, by the power supply, the second voltage during less than all of pulse width modulation (PWM) on times of a uLED that is not operable by the first voltage.

In Example 8, at least one of Examples 1-7 can further include, wherein a drive current of the uLEDs of the uLED die that are not operable by the first voltage is individually modified such that an average drive current of the uLED is driven to a target average power.

Example 9 includes a system comprising a micro light emitting diode (uLED) die comprising uLEDs and respective uLED drivers, a power supply, a controller configured to provide a first command that causes the power supply to provide, during a first time, electrical power with a first voltage to the uLED drivers, the first voltage sufficient to operate a majority of the uLEDs, and provide a second command that causes the power supply to provide, at a second time after the first time, electrical power with a second voltage, the second voltage higher than the first voltage and sufficient to operate uLEDs of the uLED die that are not operable by the first voltage.

In Example 10, Example 9 can further include, wherein the second time is in sync with a pulse width modulation (PWM) on period of a uLED of the uLEDs that are not operable by the first voltage.

In Example 11, Example 10 can further include test equipment configured to determined, for each uLED of the uLED die, whether the uLED is operable by the first voltage, and a memory accessible by a controller of the uLED die configured to store data indicating an identification (ID) of each uLED of the uLED die that is not operable by the first voltage.

In Example 12, Example 11 can further include, wherein the controller is further configured to issue a command to the power supply that causes the power supply to provide electrical power at a third voltage greater than the first and second voltages.

In Example 13, Example 9 can further include, wherein the controller is further configured to, during a single pulse width modulation (PWM) on period of a uLED Of the uLEDs that are not operable by the first voltage, cause the power supply to provide electrical power at the first voltage and the second voltage a plurality of times.

In Example 14, at least one of Examples 9-13 can further include, wherein the controller is further configured to cause the power supply to provide the second voltage during every PWM cycle on time of a uLED that is not operable by the first voltage.

In Example 15, at least one of Examples 9-14 can further include, wherein the controller is further configured to cause the power supply to provide the second voltage during less than all of pulse width modulation (PWM) on times of a uLED that is not operable by the first voltage.

Example 16 includes a machine-readable medium including instructions that, when executed by a machine, cause the machine to perform operations comprising providing a first command that causes a power supply coupled to a micro light emitting diode (uLED) die, to provide, during a first time, electrical power with a first voltage to uLED drivers of the uLED die, the first voltage sufficient to operate a majority of uLEDs of the uLED die, and providing a second command that causes the power supply to provide, at a second time after the first time, electrical power with a second voltage, the second voltage higher than the first voltage and sufficient to operate uLEDs of the uLED die that are not operable by the first voltage.

In Example 17, Example 16 can further include, wherein the second time is in sync with a pulse width modulation (PWM) on period of a uLED of the uLEDs that are not operable by the first voltage.

In Example 18, at least one of Examples 16-17 can further include, wherein the operations further comprise determining, for each uLED of the uLED die, whether the uLED is operable by the first voltage, and storing, by a memory accessible by a controller of the uLED die, data indicating an identification (ID) of each uLED of the uLED die that is not operable by the first voltage.

In Example 19, Example 18 can further include, wherein the operations further comprise issuing a command that causes the power supply to provide electrical power at a third voltage greater than the first and second voltages.

In Example 20, at least one of Examples 16-19 can further include, wherein the operations further comprise, during a single pulse width modulation (PWM) on period of a uLED Of the uLEDs that are not operable by the first voltage, cause the power supply to provide electrical power at the first voltage and the second voltage a plurality of times. While example embodiments of the present disclosed subject matter have been shown and described herein, it will be obvious to those skilled in the art that such embodiments are provided by way of example only. Numerous variations, changes, and substitutions will now occur to those skilled in the art, upon reading and understanding the material provided herein, without departing from the disclosed subject matter. It should be understood that various alternatives to the embodiments of the disclosed subject matter described herein may be employed in practicing the various embodiments of the subject matter. It is intended that the following claims define the scope of the disclosed subject matter and that methods and structures within the scope of these claims and their equivalents be covered thereby.

What is claimed is:

1. A method comprising:

providing, by a power supply and during a first time, electrical power with a first voltage that is sufficient to operate a majority of micro light emitting diodes (uLEDs) of a uLED die to respective uLED drivers of the uLED die;

driving the majority of uLEDs of the uLED die using the uLED drivers during the first time;

providing, by the power supply and during a second time after the first time, electrical power with a second voltage, the second voltage being higher than the first voltage, the second voltage sufficient to operate uLEDs of the uLED die that are not operable by the first voltage; and driving the majority of the uLEDs and the uLEDs of the uLED die that are not operable by the first voltage during the second time.

2. The method of claim 1, wherein the second time is in sync with a pulse width modulation (PWM) on period of a uLED of the uLEDs that are not operable by the first voltage.

3. The method of claim 2, further comprising:

testing, by test equipment, each uLED of the uLED die to determine whether the uLED is operable by the first voltage; and storing, in a memory accessible by a controller of the uLED die, data indicating an identification (ID) of each uLED of the uLED die that is not operable by the first voltage.

4. The method of claim 3, further comprising:

issuing, by the controller, a command to the power supply that causes the power supply to provide electrical power at the second voltage.

5. The method of claim 1, further comprising during a single pulse width modulation (PWM) on period of a uLED Of the uLEDs that are not operable by the first voltage, providing, by the power supply, electrical power at the first voltage and the second voltage a plurality of times.

6. The method of claim 1, further comprising:

providing, by the power supply, the second voltage during every pulse width modulation cycle on time of a uLED that is not operable by the first voltage.

7. The method of claim 1, further comprising:

providing, by the power supply, the second voltage during less than all of pulse width modulation (PWM) on times of a uLED that is not operable by the first voltage.

8. The method of claim 1, wherein a drive current of the uLEDs of the uLED die that are not operable by the first voltage is individually modified such that an average drive current of the uLED is driven to a target average power.

9. A system comprising:

a micro light emitting diode (uLED) die comprising uLEDs and respective uLED drivers;

a power supply;

a controller configured to:

provide a first command that causes the power supply to provide, during a first time, electrical power with a first voltage to the uLED drivers, the first voltage sufficient to operate a majority of the uLEDs; and provide a second command that causes the power supply to provide, at a second time after the first time, electrical power with a second voltage, the second voltage higher than the first voltage and sufficient to operate uLEDs of the uLED die that are not operable by the first voltage.

10. The system of claim 9, wherein the second time is in sync with a pulse width modulation (PWM) on period of a uLED of the uLEDs that are not operable by the first voltage.

11. The system of claim 10, further comprising:

test equipment configured to determined, for each uLED of the uLED die, whether the uLED is operable by the first voltage; and a memory accessible by a controller of the uLED die configured to store data indicating an identification (ID) of each uLED of the uLED die that is not operable by the first voltage.

12. The system of claim 11, wherein the controller is further configured to issue a command to the power supply that causes the power supply to provide electrical power at a third voltage greater than the first and second voltages.

13. The system of claim 9, wherein the controller is further configured to, during a single pulse width modulation (PWM) on period of a uLED Of the uLEDs that are not operable by the first voltage, cause the power supply to provide electrical power at the first voltage and the second voltage a plurality of times.

14. The system of claim 9, wherein the controller is further configured to cause the power supply to provide the second voltage during every PWM cycle on time of a uLED that is not operable by the first voltage.

15. The system of claim 9, wherein the controller is further configured to cause the power supply to provide the second voltage during less than all of pulse width modulation (PWM) on times of a uLED that is not operable by the first voltage.

16. A machine-readable medium including instructions that, when executed by a machine, cause the machine to perform operations comprising:

providing a first command that causes a power supply coupled to a micro light emitting diode (uLED) die, to provide, during a first time, electrical power with a first voltage to uLED drivers of the uLED die, the first voltage sufficient to operate a majority of uLEDs of the uLED die; and providing a second command that causes the power supply to provide, at a second time after the first time, electrical power with a second voltage, the second voltage higher than the first voltage and sufficient to operate uLEDs of the uLED die that are not operable by the first voltage.

17. The machine-readable medium of claim 16, wherein the second time is in sync with a pulse width modulation (PWM) on period of a uLED of the uLEDs that are not operable by the first voltage.

18. The machine-readable medium of claim 16, wherein the operations further comprise:

determining, for each uLED of the uLED die, whether the uLED is operable by the first voltage; and storing, by a memory accessible by a controller of the uLED die, data indicating an identification (ID) of each uLED of the uLED die that is not operable by the first voltage.

19. The machine-readable medium of claim 18, wherein the operations further comprise issuing a command that causes the power supply to provide electrical power at a third voltage greater than the first and second voltages.

20. The machine-readable medium of claim 16, wherein the operations further comprise, during a single pulse width modulation (PWM) on period of a uLED Of the uLEDs that are not operable by the first voltage, cause the power supply to provide electrical power at the first voltage and the second voltage a plurality of times.

* * * * *